US005937676A

United States Patent [19]

Jeon

[11] Patent Number: 5,937,676

[45] Date of Patent: Aug. 17, 1999

[54] SUSPENSION SYSTEM OF A WASHING MACHINE

[75] Inventor: Un-Su Jeon, Seoul, Rep. of Korea

[73] Assignee: Daewoo Electronics Co., Ltd., Seoul, Rep. of Korea

[21] Appl. No.: 08/982,371

[22] Filed: Dec. 2, 1997

[30] Foreign Application Priority Data

Jan. 29, 1997 [KR] Rep. of Korea ..... 97-1209

[51] Int. Cl.[6] ..... D06F 37/24

[52] U.S. Cl. ..... 68/23.3; 248/610; 248/638; 267/71; 267/74; 267/141; 403/223

[58] Field of Search ..... 68/23.1, 23.3; 248/610, 638; 403/220, 223, 291; 267/70, 71, 73, 74, 140, 140.3, 141, 152, 153

[56] References Cited

U.S. PATENT DOCUMENTS

| | | | |
|---|---|---|---|
| 3,744,746 | 7/1973 | Weir et al. | 248/638 X |
| 4,343,452 | 8/1982 | Bauer | 248/565 |
| 4,991,412 | 2/1991 | Bauer et al. | 248/638 X |
| 5,117,659 | 6/1992 | Sharp et al. | 68/23.3 |
| 5,613,380 | 3/1997 | Savkar | 68/23.3 |

FOREIGN PATENT DOCUMENTS

| | | | |
|---|---|---|---|
| 34569 | 3/1977 | Japan | 68/23.3 |
| 22964 | 2/1979 | Japan | 68/23.3 |
| 2278969 | 1/1995 | United Kingdom . | |

*Primary Examiner*—Philip R. Coe
*Attorney, Agent, or Firm*—Smith, Gambrell & Russell, LLP; Beveridge, DeGrandi, Weilacher & Young Intellectual Property Group

[57] ABSTRACT

A suspension system of a washing member is comprised of two rods each connected with an upper main suspensor and a lower main suspensor and a secondary suspensor disposed at adjacent ends between the individual rods. The secondary suspensor is comprised of a creased hollow cylindrical rubber casing and a sponge encompassing the rubber member. The suspension system reduces vibration of a water basket to a body.

3 Claims, 3 Drawing Sheets

SUSPENSION SYSTEM OF A WASHING MACHINE

BACKGROUND OF THE INVENTION

1. Field of the Invention

The present invention relates to a suspension system of a washing machine, and more particularly to a suspension system of a washing machine in which a secondary suspensor is disposed at adjacent ends between individual rods.

2. Description of the Prior Art

Generally, a suspension system is installed for suspending a water basket and also for preventing imbalance of a water basket which is generated by vibration during a clothes washing mode and dehydrating mode.

FIG. 3 illustrates the typical washing machine having a conventional suspension system, which is revealed in U.S. Pat. No. 5,117,659. The washing machine is comprised of a body 14, a water basket 20 suspended from a frame 40 of the body by a plurality of suspension systems 34, in this case four, each of those is arranged at each corner of the body, and a clothes drum 26 mounted rotatably in the water basket 20. The suspension system 34 comprises a single solid rod 46, an upper main suspensor 44 formed at an upper end of the rod 46 and a lower main suspensor 36 formed at a lower end of the rod 46. The lower main suspensor 36 is connected with the water basket 20 by a bracket 35. Normally, a rubber or resin ball is used as the upper main suspensor 44, whereas a tension spring is used as the lower main suspensor 36. During washing mode and dehydrating mode, vibration of the water basket generated by driving motor and an imbalance of clothes is dampened by the suspension system.

That is, the water basket is unstably rotated owing to the vibration of the driving motor and an imbalance of the clothes during the washing mode and the dehydrating mode. The unstable turning is dampened by the lower main suspensor of the suspension system. However, part of the vibration is transmitted through the solid rod to the upper main suspensor. The presently used upper main suspensor inefficiently prevents the vibration. Therefore, the vibration is transmitted to the body, thus leading to noise of the washing machine.

SUMMARY OF THE INVENTION

Therefore, it is an object of the present invention to provide a suspension system of a washing machine to solve the problems.

It is another object of the present invention to provide a suspension system of a washing machine for reducing vibration of a water basket to a body.

In order to achieve the above objects of the present invention, a suspension system of a washing machine is comprised of two rods, an upper end of the upper rod connected with a frame by an upper main suspensor and a lower end of the lower rod connected with a water basket by a lower main suspensor; and a secondary suspensor provided between adjacent ends of two rods.

Further, the secondary suspensor is comprised of an elastic casing connecting with each end of two rods and a sponge encompassing said elastic casing.

Furthermore, the elastic casing has a creased hollow cylinder shape.

Next, each peak portion of the creased hollow cylinder is extended perpendicular to an axis of the cylinder.

BRIEF DESCRIPTION OF THE DRAWINGS

The above objects and other advantages of the present invention will be better clarified by describing a preferred embodiment thereof with reference to the accompanying drawings in which.

DESCRIPTION OF THE PREFERRED EMBODIMENT

Figure 1:
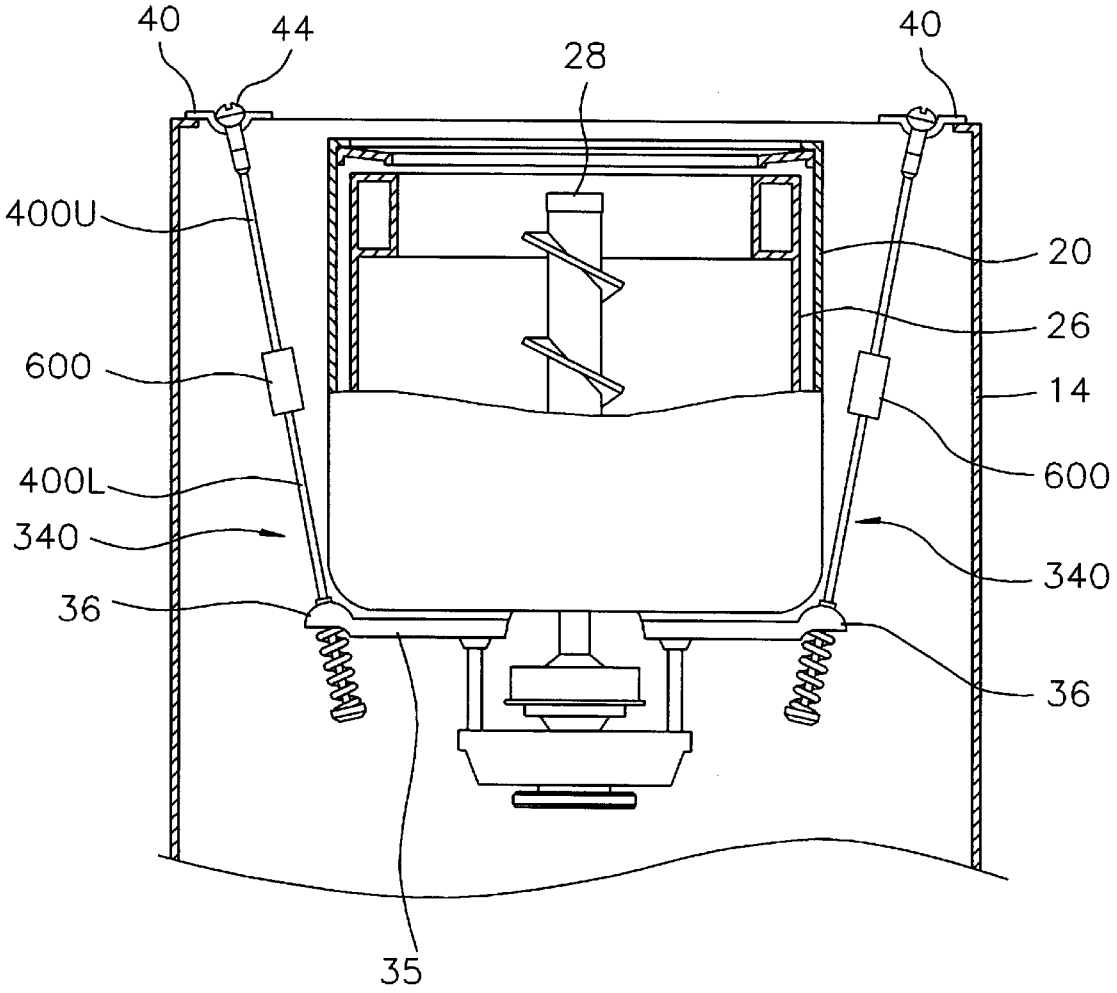
FIG. 1 is a partial sectional view of a washing machine having a suspension system according to the present invention.
Figure 2:
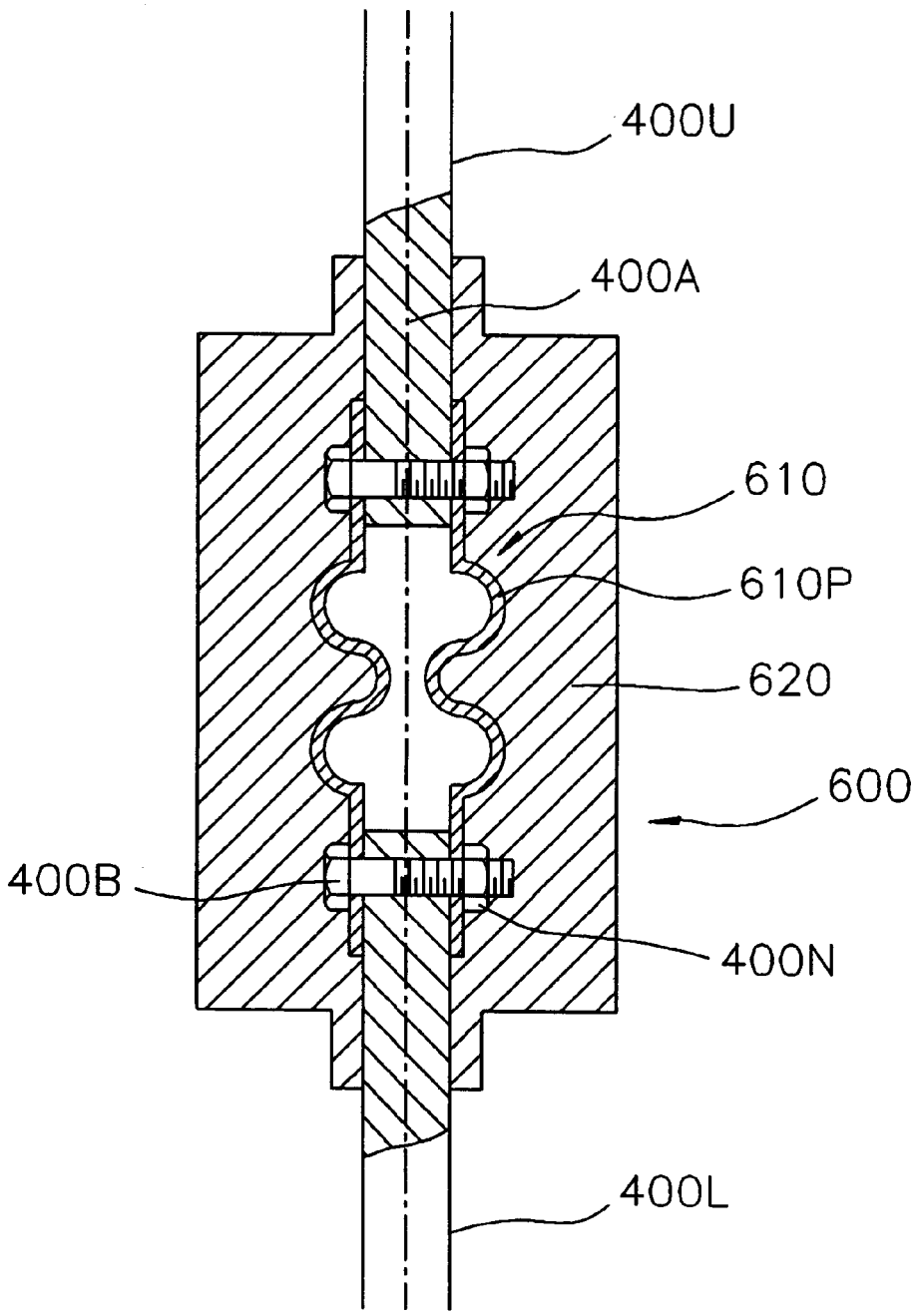
FIG. 2 is an enlarged vertical cross sectional view of a secondary suspensor of FIG. 1.
Figure 3:
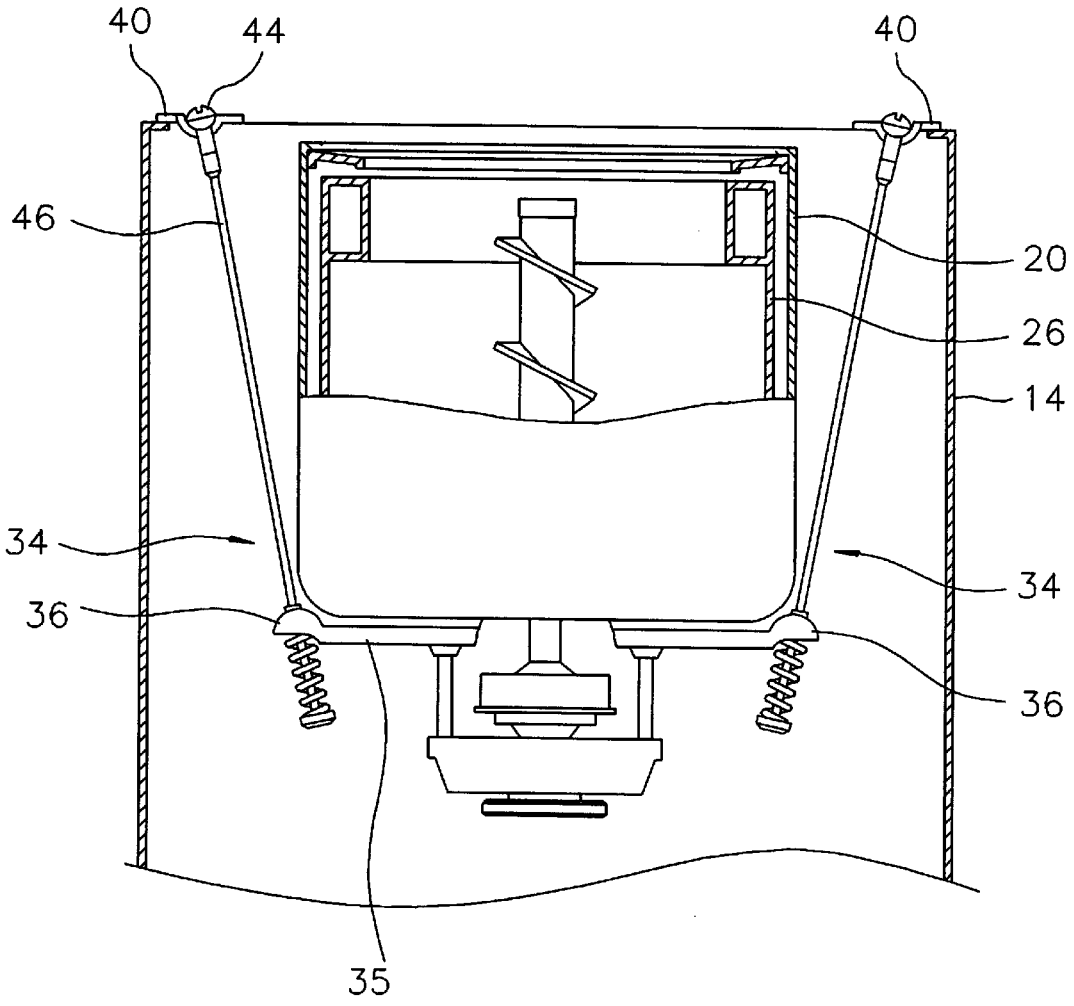
FIG. 3 PRIOR ART
FIG. 3 is a vertical elevational view of a washing machine having a conventional suspension system according to a prior art.

Hereafter, the invention will be described in further detail with reference to the accompanying drawings. The component parts as those in FIG. 1 are designated by the same reference numerals as the corresponding parts of conventional embodiment of FIG. 3, so a detailed description of those parts will be omitted.

A water basket 20 is disposed in suspension in a body 14 of a washing machine. A suspension system 340 is disposed between a frame 40 and a bracket 35 which connects the suspension system 340 to the water basket 20. In this embodiment, the suspension system 340 is located at each corner of the square body 14. The suspension system 340 is comprised of two individual rods 400U,400L i.e., an upper rod 400U and a lower rod 400L and a secondary suspensor 600. The upper rod 400U has an upper main suspensor 44 at an upper end of the upper rod 400U, whereas the lower rod 400L has a lower main suspsensor 36 at a lower end of the lower rod 400L. The secondary suspensor 600 is disposed between a lower end of the upper end 400U and an upper end of the lower rod 400L, by which vibration of the water basket 20 is prevented from being transmitted to the body 14.

The secondary suspensor 600 is comprised of an elastic casing 610 connected with each end of two rods 400U,400L by bolt 400B and nut 400N, and a sponge 620 encompassing the elastic casing 610. The elastic casing is made of a rubber and has a folding bellows hollow cylinder shape. A plurality of peaked portions 610P of the folding bellows hollow cylinder are arranged perpendicular to axis 400A of the rods 400U, 400L.

The washing machine having the suspension system constructed according to the present invention operates as described below.

After the washing mode has been completed, and the machine orders the dehydration mode there is great potential for excessive vibration. This occurs because clothes are not evenly distributed within a spinning drum. The unbalance rotation of the drum 26 is transmitted to the water basket 20 which is connected to the drum 26 by an agitator 28, leading to unstable rotation of the water basket 20. The vibration of the water basket 20 is camped by the vibration absorbing force of the lower main suspensor 36. Most of vibration which will be transmitted to the lower rod 400L is reduced.

The still active vibration of the water basket 20 is transmitted to the upper rod 400U through the lower rod 400L. However, the minute vibration of the water basket 20 is prevented from being transferred to the upper rod 400U owing to the secondary suspensor 600 which is disposed between the upper rod 400U and the lower rod 400L.

That is, the still active vibration which has not been diminished even though the lower main suspensor 36 advances to the upper portion of the lower rod 400L. The advancing vibration wave arrives at the elastic casing 610 of the secondary suspensor 600. Thus, most vibration of the lower rod 600L can be diminished because of the damping force of the elastic casing 610. The remain vibration which has not been caught at the elastic casing 610 is transmitted to the sponge 620. In the end, all vibration of the washing basket can be diminished.

According to the present invention as described above, since the rod is separated into two parts, one of the rods is connected to the frame through the upper main suspensor, the other of the rods is connected to the washing basket through the lower main suspensor, and a secondary suspensor is disposed between the rods. The vibration generated by the water basket can be diminished primarily by the vibration absorbing force of the elastic casing, and the remaining vibration is absolutely caught by the sponge encompassing the elastic casing. This leads to the stable rotation of the water basket and the prevention of the vibration being transmitted to the body. Further, the noise generated by vibration can be diminished, thus enhancing the reliability of the washing machine.

What is claimed:

1. A suspension system of a washing machine for use between a frame and a water basket suspended in said frame and housing a rotatable drum, said suspension system comprising:

two rods comprising an upper rod and a lower rod, an upper end of said upper rod connected with said frame by an upper main suspensor and a lower end of said lower rod connected with said water basket by a lower main suspensor; and a secondary suspensor provided between adjacent ends of two rods, and comprising an elastic casing connecting with each end of two rods and a sponge encompassing said elastic casing.

2. The suspension system of a washing machine according to claim 1, wherein said elastic casing has a folding bellows hollow cylinder shape.

3. The suspension system of a washing machine according to claim 2, wherein a plurality of peaked portions of said folding bellows hollow cylinder are arranged perpendicular to an axis of said cylinder.

* * * * *